United States Patent [19]

Schlage

[11] 4,073,527

[45] Feb. 14, 1978

[54] ELECTRICALLY CONTROLLED DOOR LOCK

[75] Inventor: Ernest L. Schlage, Burlingame, Calif.

[73] Assignee: Schlage Lock Company, San Francisco, Calif.

[21] Appl. No.: 758,691

[22] Filed: Jan. 12, 1977

[51] Int. Cl.[2] ..... E05C 1/16

[52] U.S. Cl. ..... 292/347; 292/144; 292/352; 297/DIG. 27

[58] Field of Search ..... 292/144, 201, 347, 352, 292/DIG. 27

[56] References Cited

U.S. PATENT DOCUMENTS

| | | | |
|---|---|---|---|
| 1,743,955 | 1/1930 | Brauning et al. | 292/352 |
| 3,360,970 | 1/1968 | Hays, Jr. | 292/144 X |

FOREIGN PATENT DOCUMENTS

| | | | |
|---|---|---|---|
| 590,610 | 4/1959 | Italy | 292/347 |

*Primary Examiner*—Richard E. Moore
*Attorney, Agent, or Firm*—Lothrop & West

[57] ABSTRACT

A door lock for use on a door panel has bores containing a lock mechanism including a chassis on which spindles are mounted for rotation about two parallel axes. Door handles or other lock operators are disposed on opposite ends of both spindles and are interconnected variously to operate a lock bolt and a latch bolt. The lock and latch bolts are also disposed in the bores and are joined to the chassis. One of the handles is joined to one of the spindles by a clutch including an axially movable member operated by an electromagnet within the bores, the electromagnet being connected to the clutch member by an actuator movable in a path having an axial component.

14 Claims, 21 Drawing Figures

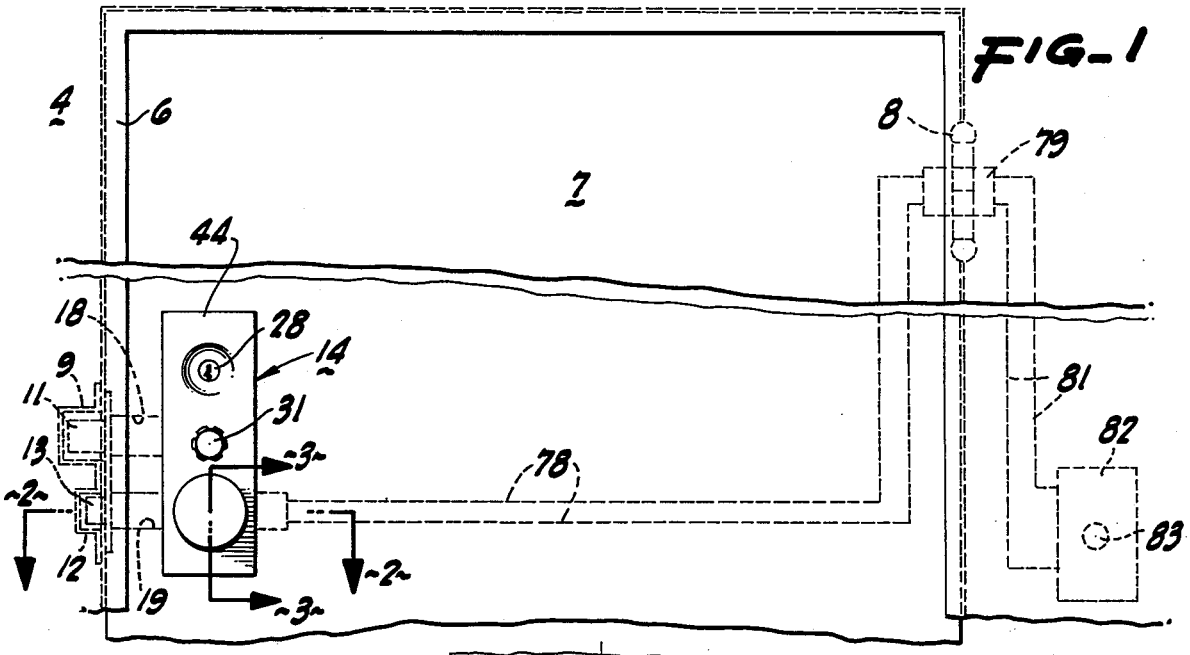
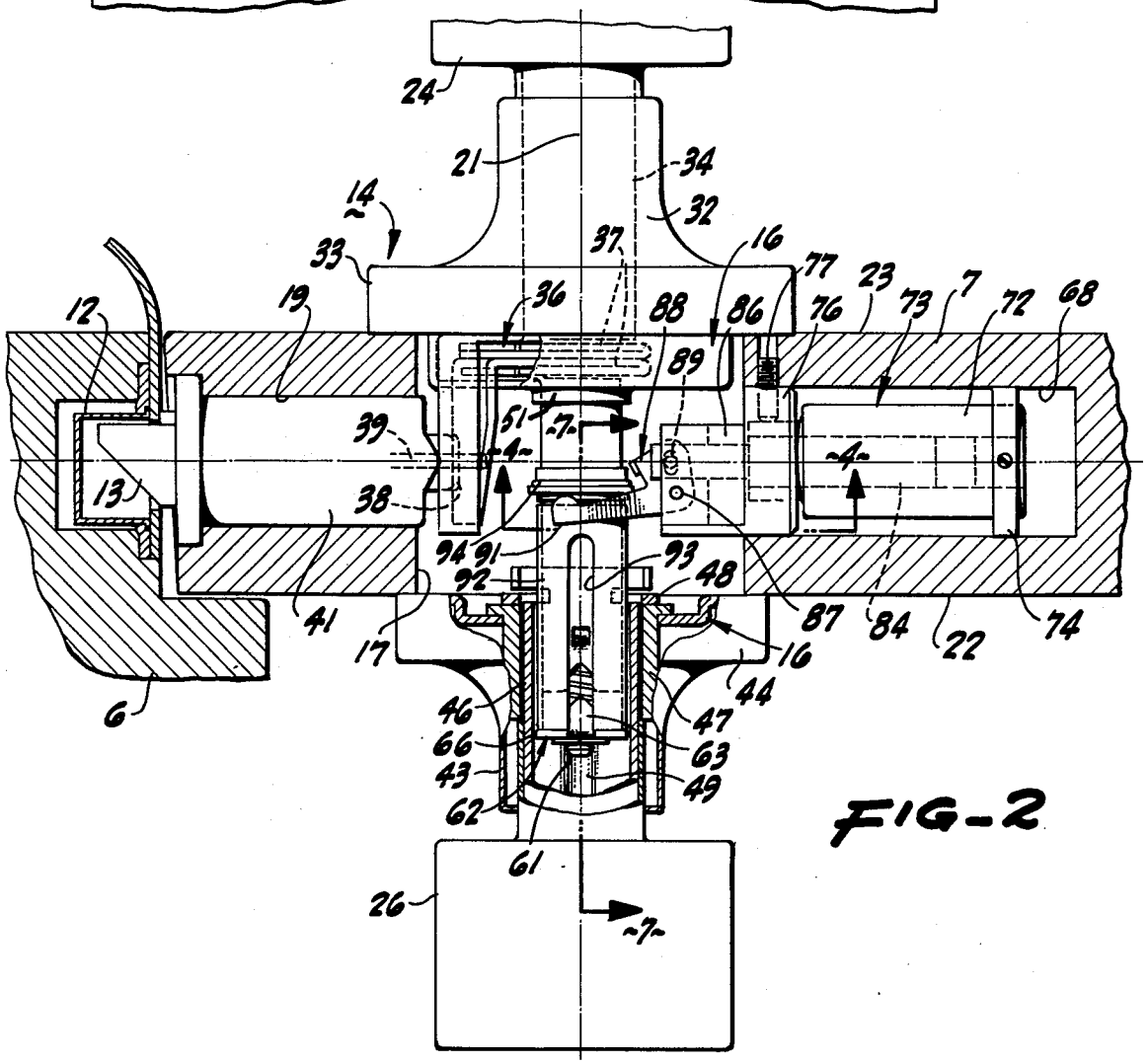
FIG-2

FIG-7
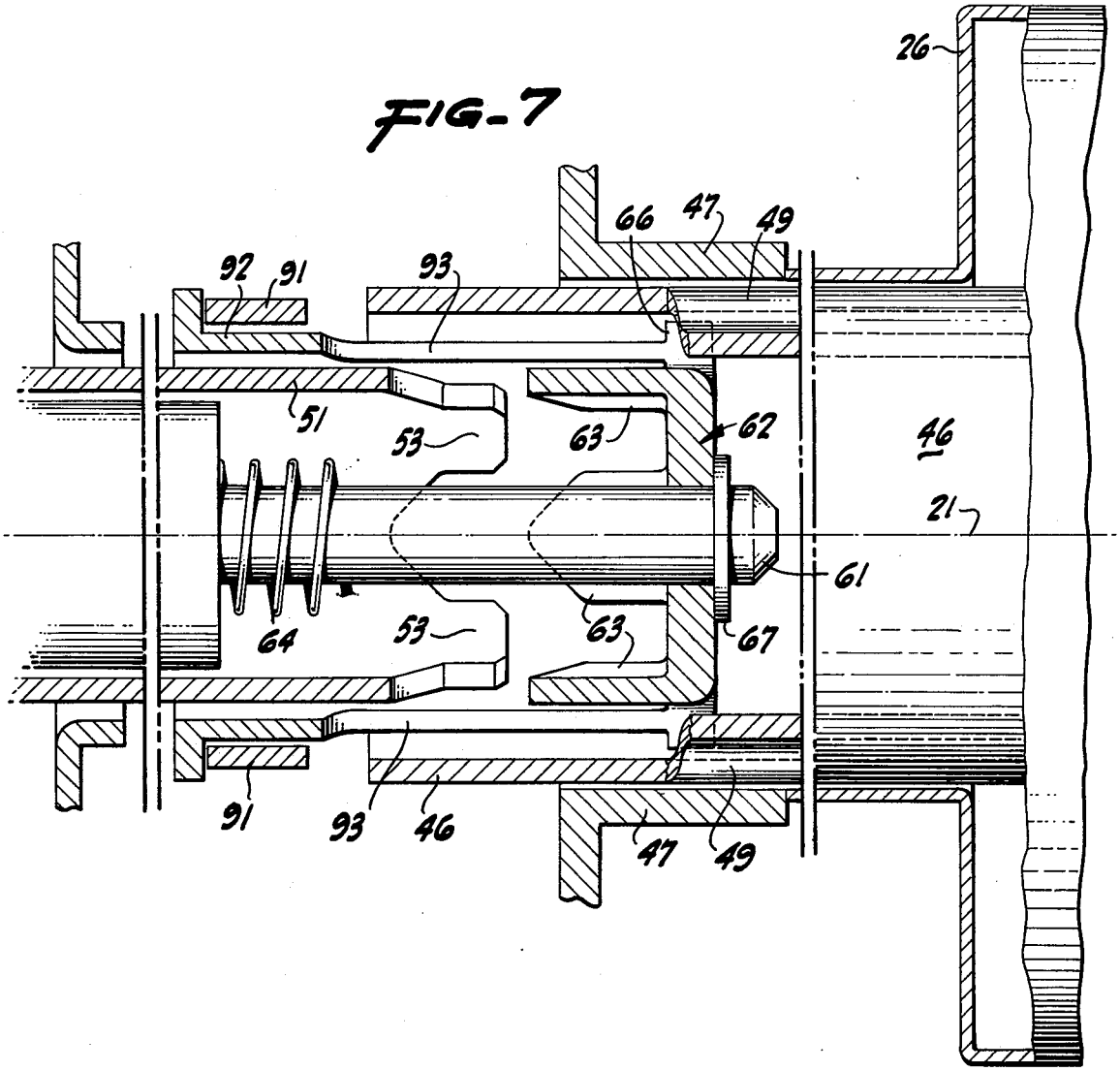
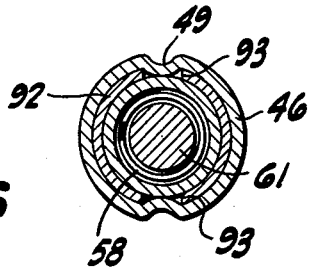
FIG-6

FIG-19
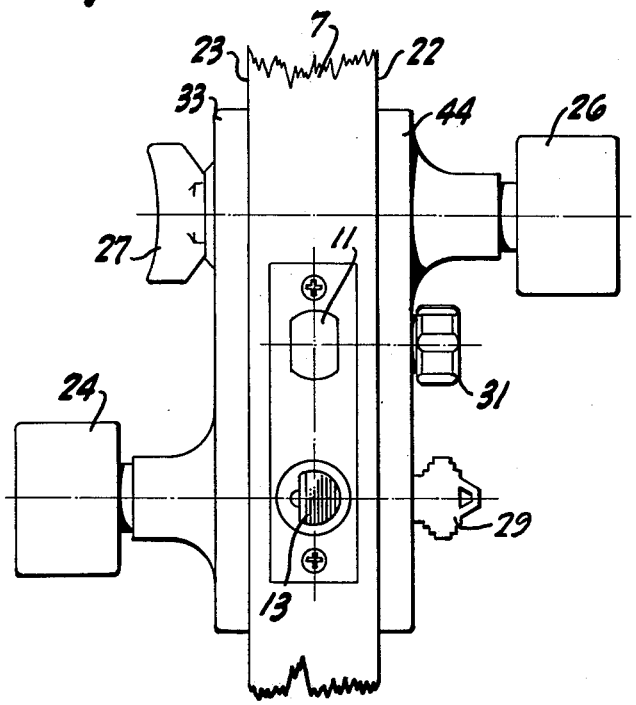
FIG-20
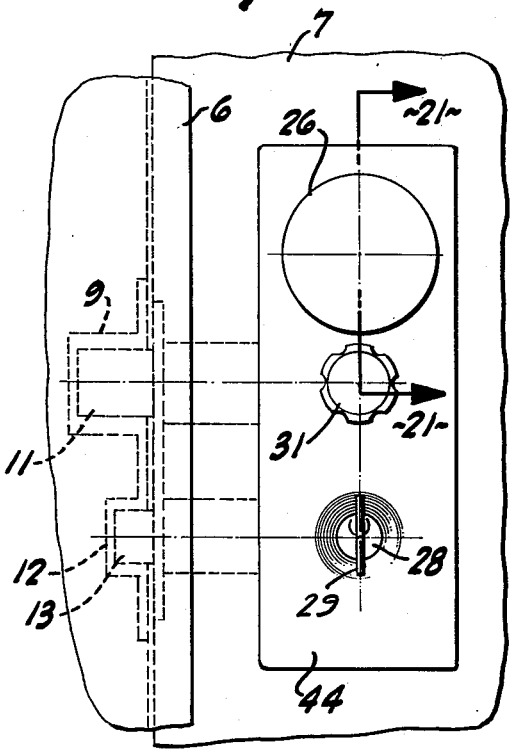
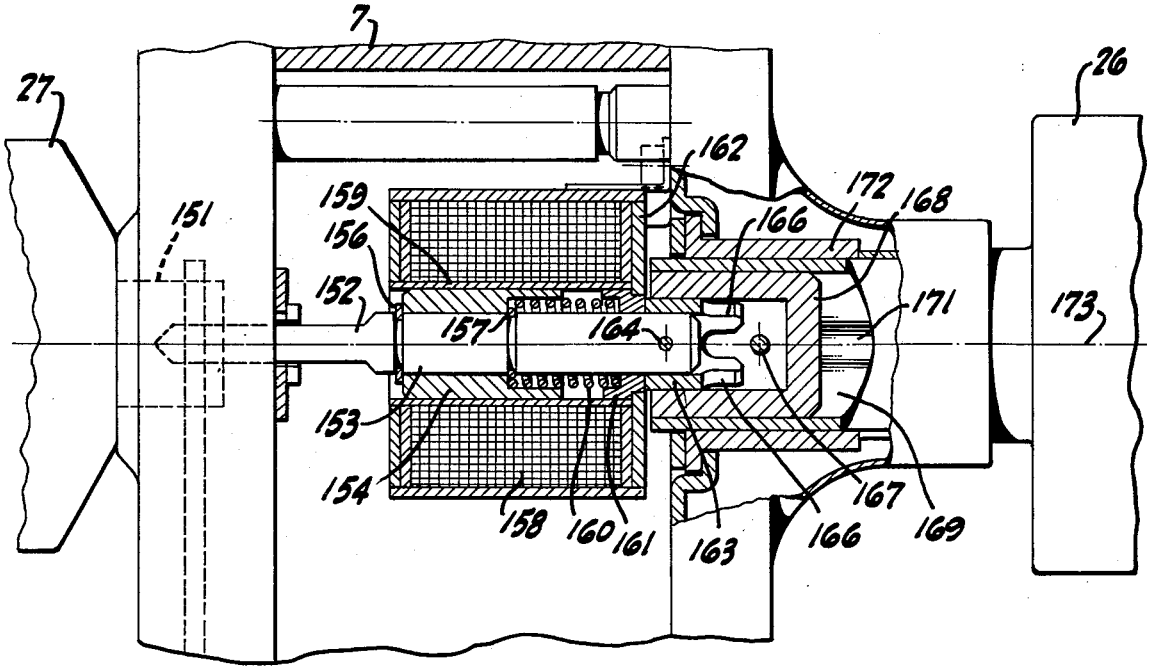
FIG-21

ELECTRICALLY CONTROLLED DOOR LOCK

BRIEF SUMMARY OF THE INVENTION

A door lock for use on a door panel having bores to receive the lock components is inclusive of a pair of spindles movable about a pair of parallel axes, there being handles or other operating devices at each end of each spindle in order to control a latch bolt and a dead bolt both interconnected to the controllers and joined to the chassis. At least one of the controllers or handles is provided with a clutch which connects and disconnects that handle from its respective spindle. The clutch is operated by an electromagnet having a coil disposed within the bores and connected so as to move the clutch along the axis in order to engage and disengage the respective handle. The electromagnetic coil is supplied with electricity through a circuit extending through the door panel and preferably through a door hinge to a remote source of control.

BRIEF DESCRIPTION OF THE SEVERAL VIEWS OF THE DRAWING

One form of the invention is shown in FIGS. 1–7 inclusive, as follows:

FIG. 1 is a side elevation, portions being broken away, of an electrically controlled door lock mounted on a door panel and shown in closed and locked condition;

FIG. 2 is a cross-section, the plane of which is indicated by the line 2—2 of FIG. 1;

FIG. 6 is a cross-section, the plane of which is indicated by the line 6—6 of FIG. 3;

FIG. 7 is a distorted cross-section with portions broken away, the plane of which is indicated by the line 7—7 of FIG. 2.

Figure 9:
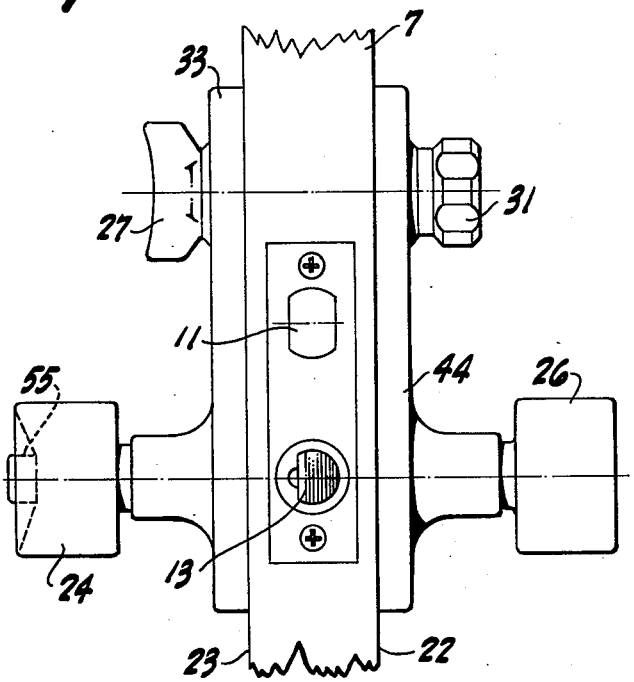
Figure 10:
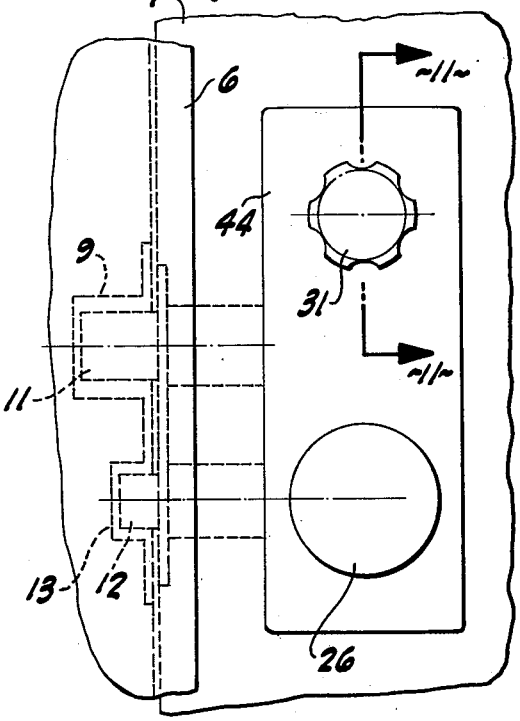
Figure 11:
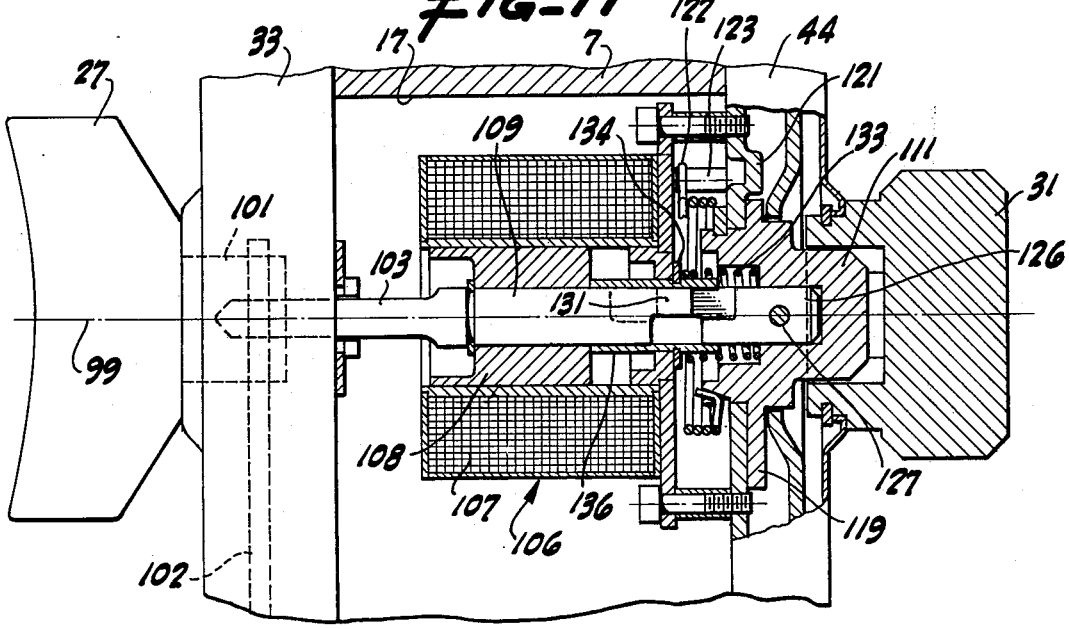
Figure 12:
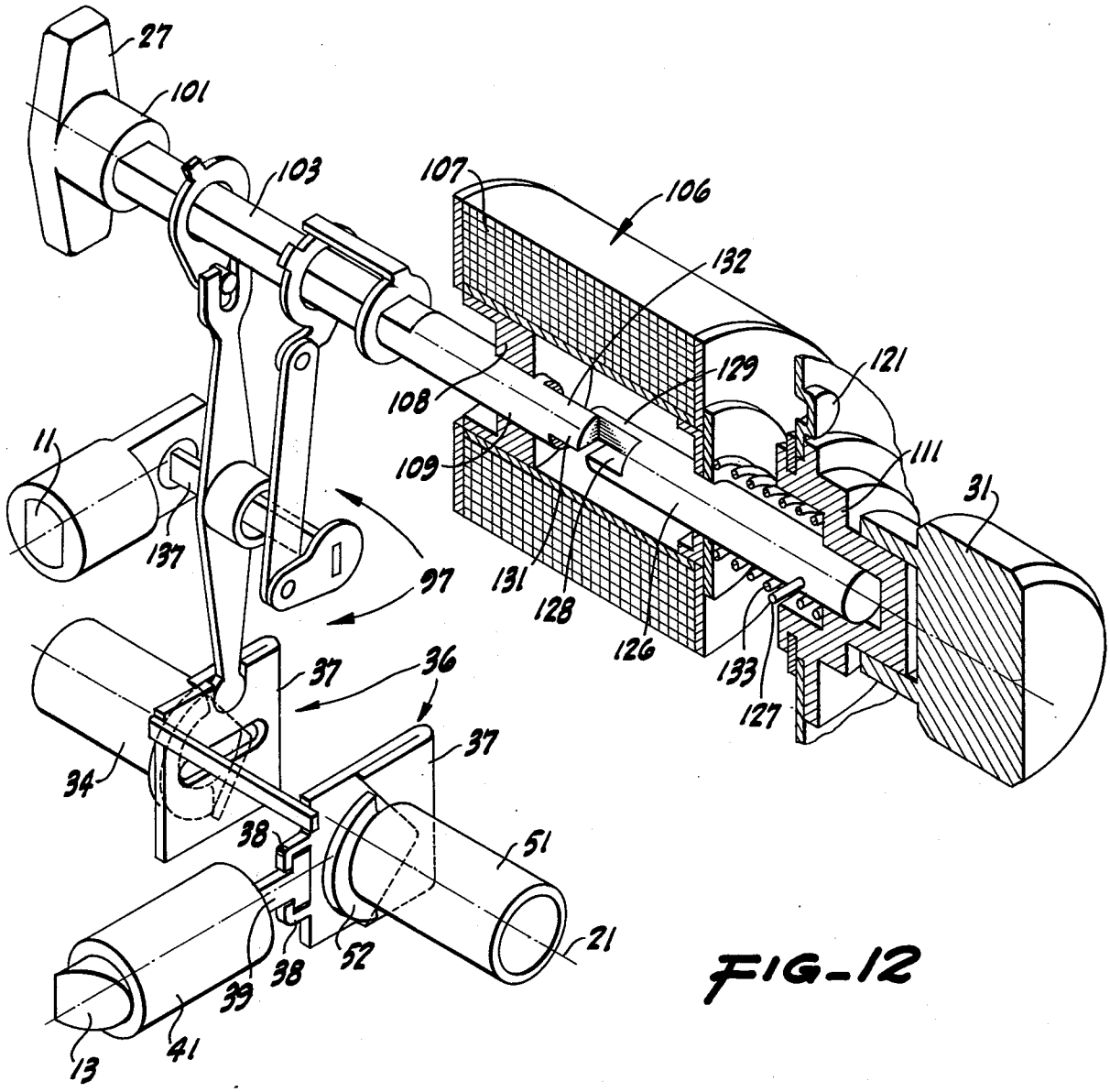
Figure 13:
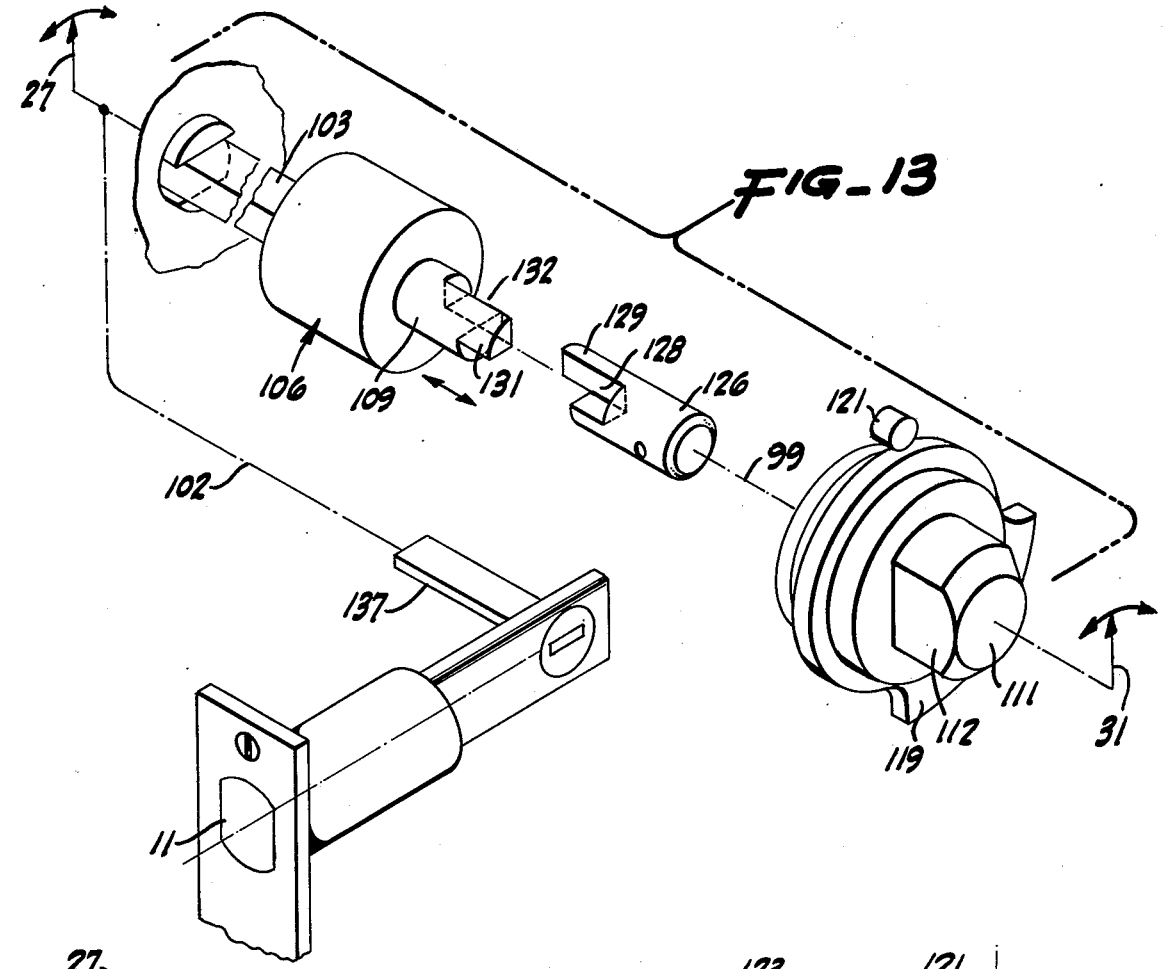
Figure 14:
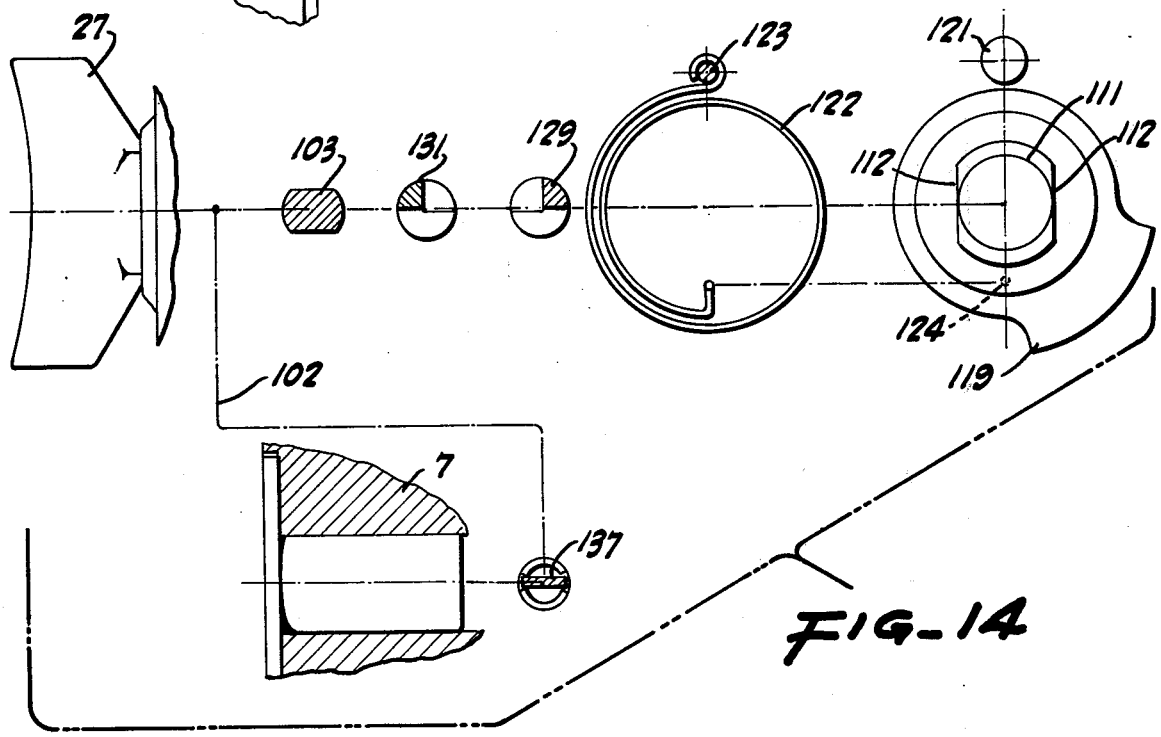
Figure 16:
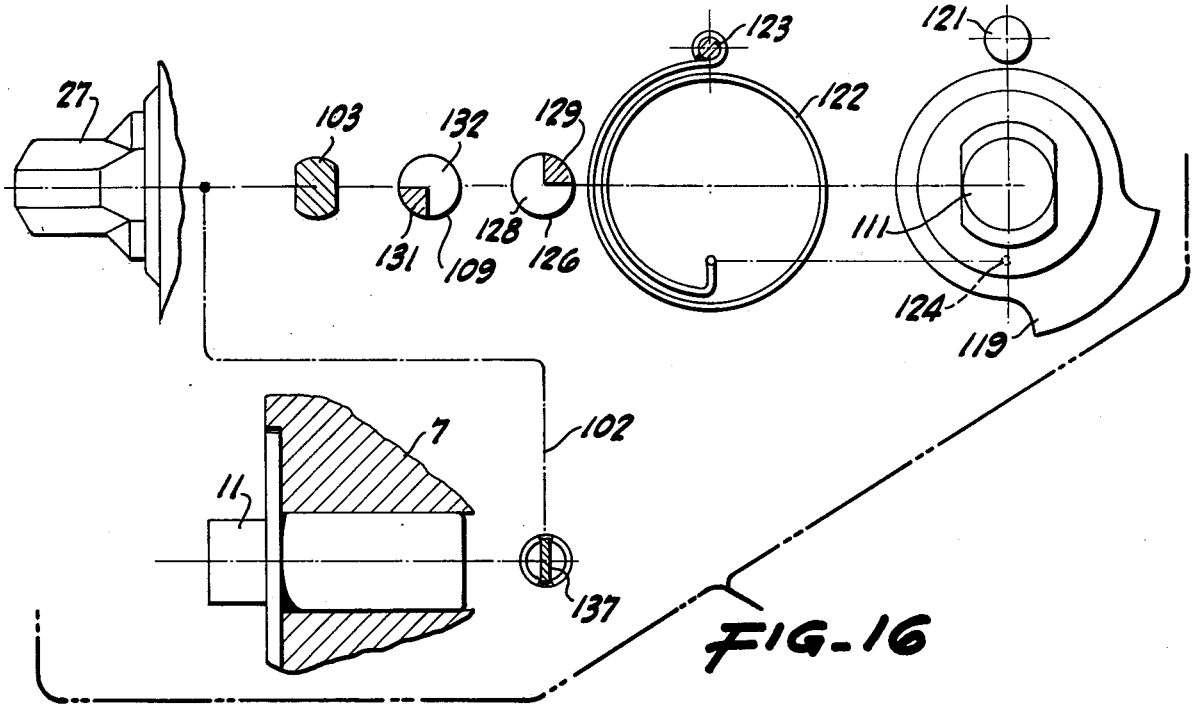
Figure 15:
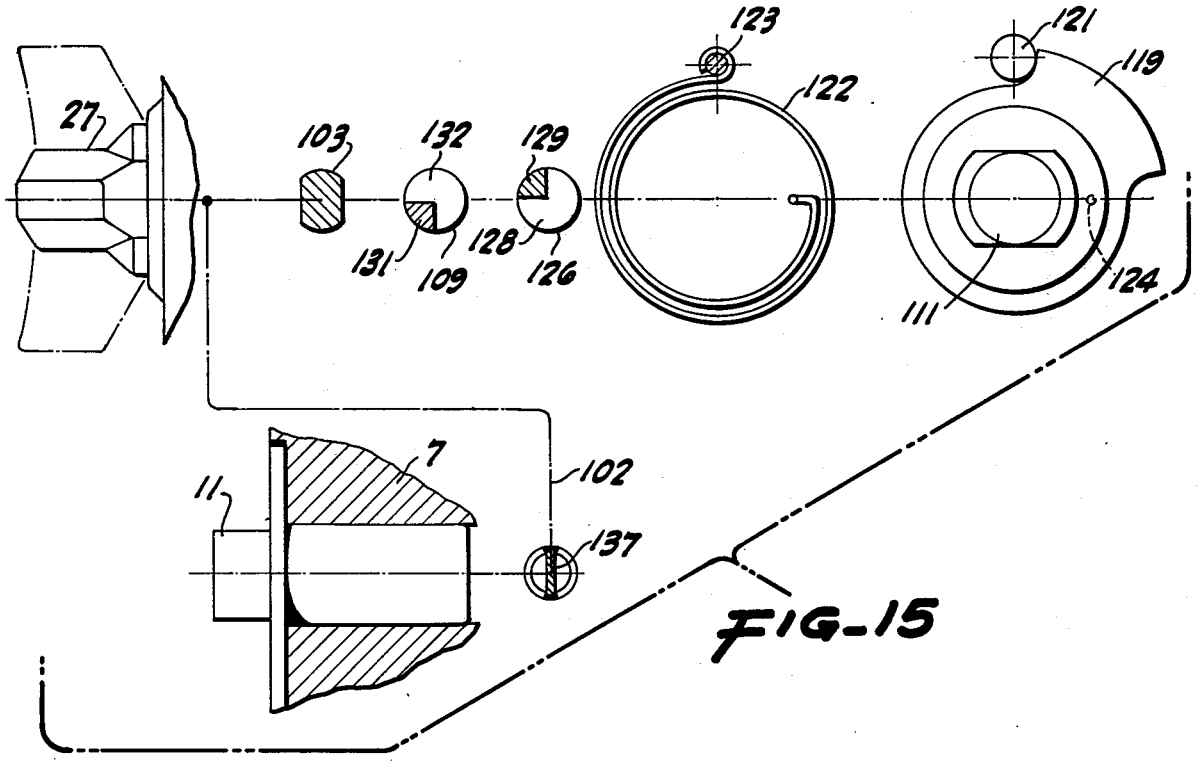
Figure 18:
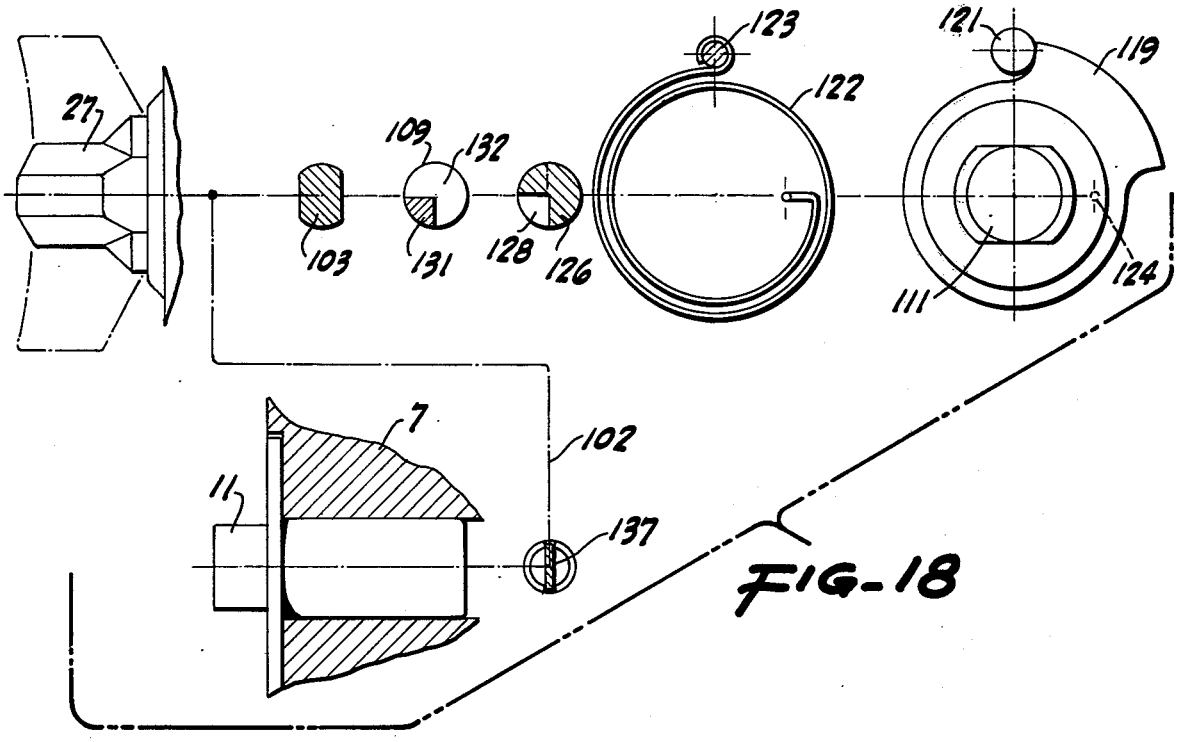
Figure 17:
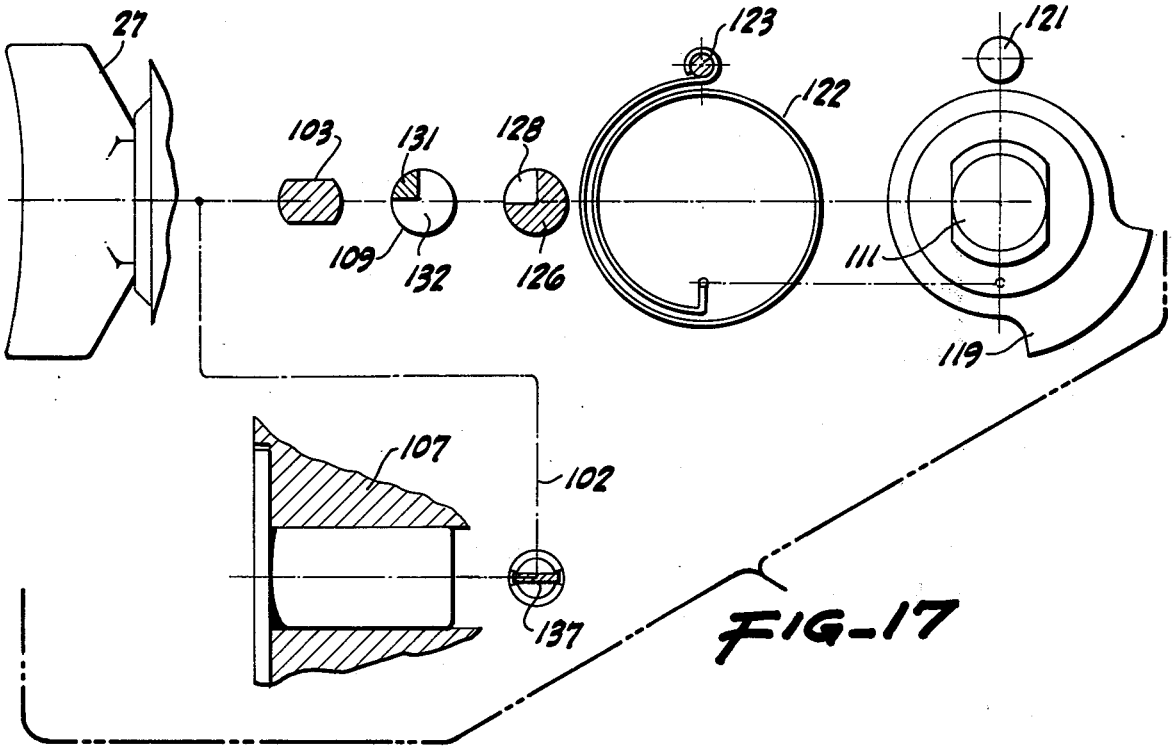

Another version of the invention is shown in FIGS. 9–18 inclusive, as follows:

FIG. 9 is an end view of a door panel, portions being broken away, showing a modified form of electrically controlled door lock installed thereon;

FIG. 10 is an elevation of portions of a door panel and associated jamb with the lock of FIG. 9 installed thereon;

FIG. 11 is a cross-section to an enlarged scale, the plane of section being indicated by the line 11—11 of FIG. 10;

FIG. 12 is a distorted isometric diagram, portions being in cross-section and portions being broken away, illustrating some internal interconnections of the lock of FIGS. 9 and 10;

FIG. 13 is an exploded, isometric diagram in dimensionally distorted form showing some of the interconnections of the lock of FIGS. 9 and 10 in one position;

FIG. 14 is a distorted diagrammatic layout of some of the parts of the lock of FIG. 13 all in one relative position, as in FIG. 13;

FIG. 15 is a view comparable to FIG. 14 but showing the parts in a different position;

FIG. 16 is a view comparable to FIGS. 14 and 15 but showing some of the parts in a still different position;

FIG. 17 is a view comparable to FIG. 16 but showing the parts in a still further different position; and FIG. 18 is a view comparable to FIG. 17 but showing the parts in a still different position.

A third version of the invention is shown in FIGS. 19–21, as follows:

FIG. 19 is an end elevation of a door panel, portions being broken away, with a modified lock installed therein;

FIG. 20 is an elevation of a door panel and door jamb with the lock of FIG. 19 installed therein; and FIG. 21 is a cross-section to an enlarged scale, the plane of section being indicated by the line 21—21 of FIG. 20.

DETAILED DESCRIPTION

In the provision of locks for door panels operating in door frames and against door jambs, it is sometimes required, particularly for multiple access buildings such as apartment houses and the like, to provide a remote control so that a tenant can operate the lock from an interior or other remote position in order to admit an authorized visitor. Often this mechanism takes the form of an electromagnetically actuated release in the strike portion of the lock located in the jamb. A wall of the strike is pulled out of the way and the door panel can then easily be swung open. No operation of the dead bolt or latch bolt of the door lock itself is involved. While in many respects this is a satisfactory arrangement, it is subject to various difficulties and is not as secure as is desired.

It is therefore an object of the invention to provide an electrically controlled door lock in which the controlled mechanism is all associated with or is connected to the lock mechanism itself as distiguished from the lock strike.

Another object of the invention is to provide an improved electriclly controlled door lock that easily can be operated electrically and from a remote point.

Another object of the invention is to provide an electrically controlled lock in which the control instrumentality can be included with normal lock parts and with only relatively small changes.

A further object of the invention is to provide an electrically controlled door lock which to external appearances is no different from standard, non-controlled door locks.

Another object of the invention is to provide an electrically controlled door lock having possible variations in its internal interconnections to afford various different lock functions.

A further object of the invention is to provide an electrically controlled door lock that can be installed very much as is a non-controlled door lock.

Other objects together with the foregoing are attained in the embodiments of the invention illustrated in the accompanying drawings and described in the accompanying description.

The basic lock with which the current improvements are utilized is disclosed in considerable detail in U.S. Pat. No. 3,390,558 issued July 2, 1968 in the name of J. A. Tornoe et al. and assigned to the assignee hereof. While many parts of that lock are again disclosed herein and are especially described, thee are other parts of the lock that are not herein directly disclosed and are not herein described. That Tornoe patent by this reference is incorporated herein.

In a typical installation, particularly as shown in FIGS. 1-8 inclusive, in a wall 4 there is provided a door frame 6 in which a door panel 7 is mounted to swing about a vertical axis by means of one or more hinge connections 8 of the standard sort. In the present instance the door panel swings away from the viewer in FIG. 1.

In the door frame 6 is a strike box 9 for a dead bolt 11, and there is also a strike box 12 for a latch bolt 13, very much as disclosed in the Tornoe patent. Mounted on and extending through the door panel 7 is a lock mechanism 14 including a chassis 16 situated in a cross bore 17 extending entirely through the panel and enlarged vertically so as readily to be intersected by an edge bore 18 for the dead bolt 11 and an edge bore 19 for the latch bolt 13. The various bores intersect and intercommunicate within the door panel. One part of the lock chassis 16 is concentric with the axis 21 of the cross bore 17. Arbitrarily, the side 22 of the door panel 7 is called the exterior, whereas the opposite side 23 is called the interior.

Figure 8:
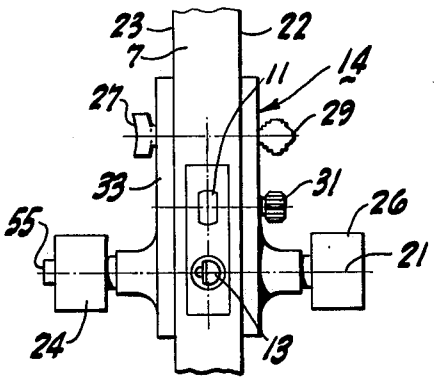
FIG. 8 is an end view of the edge of the door panel, portions being broken away.

On the interior side 23, especially as shown in FIG. 8, the chassis 16 is provided with an interior knob 24 referred to generally as a handle or operator so as to include either a solid figure of revolution or a lever or comparable actuator for the lock accessible to a person on the interior. There may be a number of other lock operators in various combinations, such as one or more of the controls shown in FIG. 8. For example, there is usually an exterior knob 26 cutomarily in alignment with the interior knob 24. There may be an interior tee turn 27, sometimes called a thumb turn, and, usually in alignment therewith, an exteriorly available pin tumbler mechanism 28 operable by a key 29 or key group. Sometimes there is also provided an exterior knob turn 31 of the sort shown in Kendrick U.S. Pat. No. 3,593,548. The handle 24 is relatively rotatable about the axis 21 and is appropriately supported within a rose 32 on an interior casing 33, as is customary.

The knob 24 rotates a spindle 34 concentric with the axis 21 and extending into a roll-back mechanism 36 including a slide 37 interengaged with hooks 38 on a draft link 39 joined to the latch bolt 13. A casing 41 around the latch bolt, as is customary, is provided with a spring, not shown, that urges the latch bolt 13 outwardly. The knob 24 functions in the usual way. By being turned in either direction about the axis 21 from a central neutral position, the knob is effective through the roll-back structure 36 to withdraw the latch bolt 13 to the full extent so that the latch bolt is free of the latch strike box 12.

The exterior knob 26 projects through a rose 43 on a casing 44 and is mounted on a relatively short spindle 46 so that the knob is also rotatable about the axis 21. The spindle 46 extends through a journal 47 in the chassis 16 and is held against axial translation by a stop arrangement 48.

The spindle 46 is generally tubular but is especially formed to have a pair of longitudinal valleys 49 therein so that it is in part non-circular. The spindle 46 extends well through the bushing 47 so as to be firmly supported.

Figure 3:
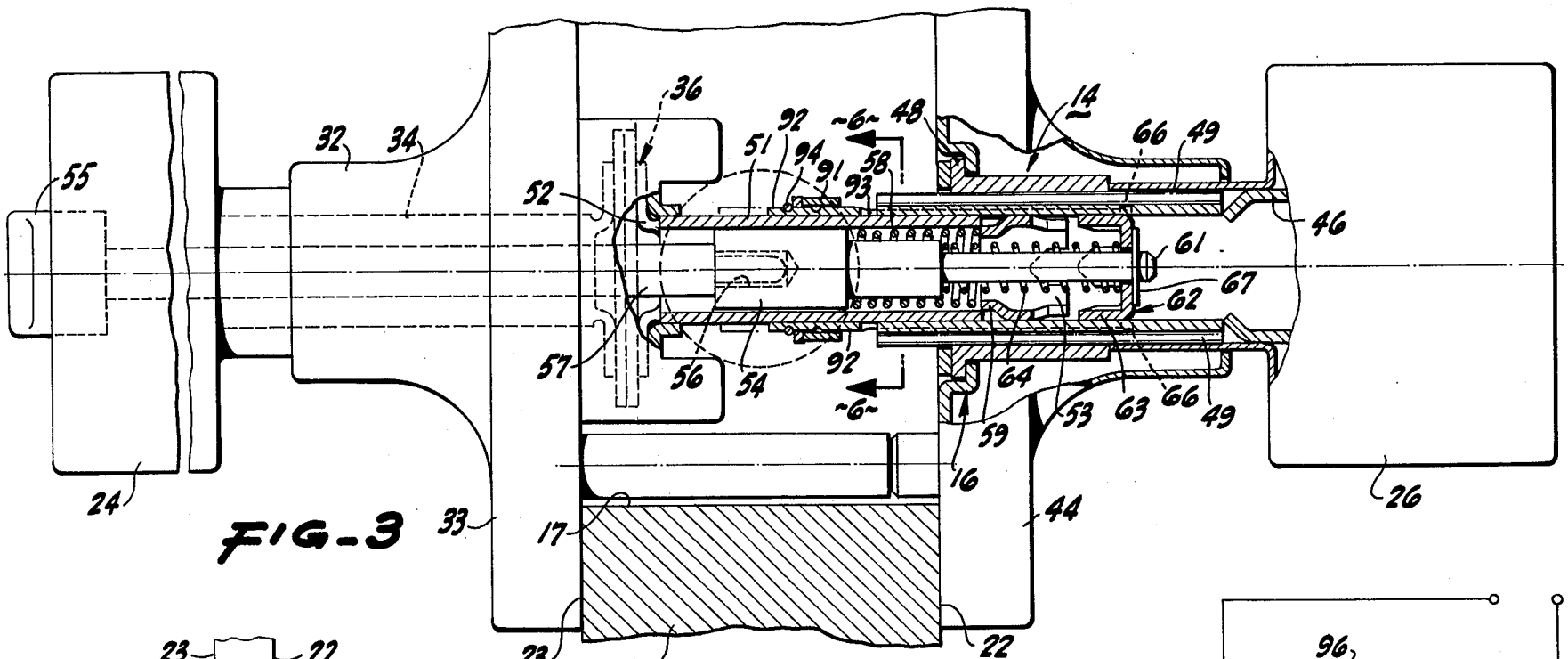
FIG. 3 is a view largely in cross-section and with portions broken away, the plane of section being indicated by the line 3—3 of FIG. 1.
Figure 5:
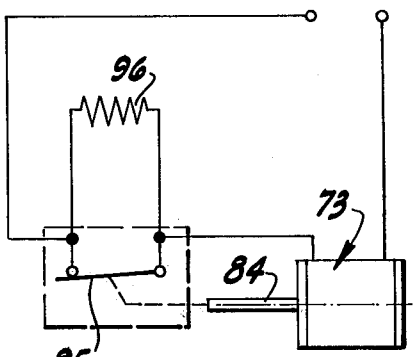
FIG. 5 is a wiring diagram for a portion of the mechanism in the preceding figures.
Figure 4:
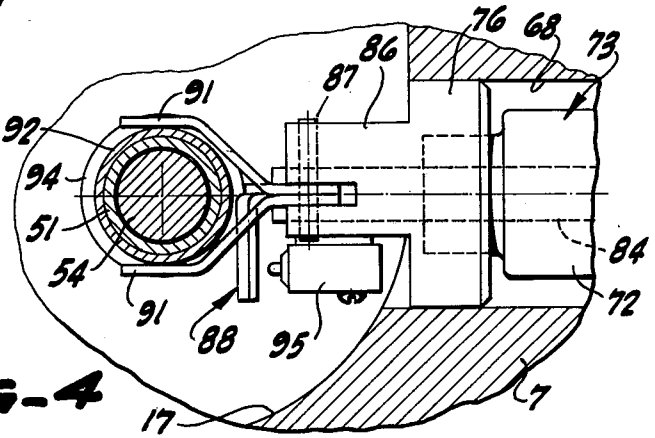
FIG. 4 is a detail in cross-section, the plane of which is indicated by the line 4—4 of FIG. 2.

Disposed in the spindle 46 is an actuating tube 51 concentric with the axis 21 and provided at one end with an extended roll-back 52 engageable with the slide 37 for actuating the latch bolt 13. The tube 51 at its other end is circularly irregular or castellated to provide jaws 53 extending axially. Within the tube 51 there is provided an actuating body 54 adapted to slide axially and having an interior bore 56. In the bore is seated the end of a controlling bar 57 joined axially to a customary control button 55 in the knob 24. A coil spring 58 at one end abuts the body 54 and at the other end abuts lugs 59 inturned on the tube 51. The tendency of the spring 58 is to urge the body 54 and the button 55 axially to the left or outwardly, as shown in FIG. 3.

Forming part of the body 54 is a stem 61 carrying a cap 62 having lugs 63 thereon complementing the jaws 53 and forming the other part of an axially effective jaw clutch. Between the cap 62 and a shoulder on the body 54 is another coil spring 64 effective to urge the cap 62 away from the end of the tube 51, so that there is usually no interconnection between them.

While the tube 51 is freely rotatable about the axis unless otherwise restrained, the cap 62 is not freely rotatable since the cap carries exterior lugs 66 interengaged with the valleys 49 of the spindle tube 46, so that the spindle tube and the cap 62 most necessarily rotate in unison, although they readily move axially with respect to each other.

In the operation of this much of the structure, when the button 55 is in an outward (leftward in FIG. 3) position, the effect of the relatively strong spring 58 is to cause the clutch cap 62, free on the stem 61 but backed by a snap washer 67, to interengage with the clutch jaws 53. There is then a solid connection between the tube 51, the spindle 46 and the exterior knob 26. Thus, when the knob 26 is rotated about the axis 21, both the spindle 46 and the tube 51 are rotated together and cause the roll-back 52 to actuate the latch bolt 13. However, when the button 55 is depressed (and in some cases locked in depressed position), then the body 54 is translated to the right, as seen in FIG. 3, thus disengaging the clutch lugs 63 from the jaws 53. Under those circumstances, rotation of the exterior knob 26 rotates the spindle 46 and the clutch cap 62, but since the clutch is disengaged, the clutch cap 62 rotates idly on the stem 61 and no rotation is transmitted to the tube 51. There is then no possible actuation of the latch bolt by the rotation of the exterior knob 26, which simply turns freely.

Particularly pursuant to the invention and as part of the installation of the lock initially, the bore 19 made for the latch bolt 13 is extended beyond the cross bore 17 and much farther than is customary to provide an extended bore 68 deeper into the door panel 7 and opening with the bore 17. In the bore 68, there is disposed the coil 72 of an electromagnetic mechanism 73. The coil is located in the bore 68 by means of peripheral rings 74 and 76, one of which is secured in position by a set screw 77. The solenoid coil 72 is joined by conductors 78 through a rotary or bendable connection 79 at the hinge 8. The conductors are continued through conductors 81 to a remote control 82 disposed at any convenient point and supplied with electrical power. Upon operation of a switch 83 or the like at the remote point, power is supplied through the hinge connector 79 into the coil 72, thus energizing the electromagnetic mechanism.

Energization of the solenoid coil 72 is effective to pull into the solenoid cavity an armature 84 partly guided in a frame 86 extending from the ring 76 into the bore 17. Mounted on the frame 86 for pivotal movement about a pin 87 is a bell crank 88 joined to the solenoid armature by a pin and slot connection 89. The bell crank has a pair of forked ends 91 straddling a sleeve 92 slidable along the tube 51. The sleeve 92 is cut away longitudinally to afford slots 93 accommodating the indented portions of the valleys 49. The sleeve 92 is secured to the lugs 66 of the clutch cap 62 so that the connected cap and sleeve can move axially in unison and rotate together. The ends of the bell crank forks 91 lie against a thrust and snap ring combination 94 on the sleeve 92. To reduce current drain, the bell crank 88 is formed to open a switch 95, just after the coil has been energized, to include a resistor 96 in the circuit.

With this arrangement, the normal position of the parts is with the clutch cap lugs 63 out of engagement with the jaws 53 so that the exterior knob 26 is freewheeling or freely rotating and produces no lock bolt action whatsoever. This is the "locked" condition on the exterior of the door. When the electromagnet mechanism 73 is energized, the armature 84 is drawn into the coil 72 and the bell crank 88 is rotated clockwise in FIG. 2. The forked arms 91 then engage the thrust and snap ring combination 94 and move the sleeve 92 to the left in FIG. 3. This brings the clutch cup lugs 63 into engagement with the jaws 53 and thus makes a solid connection between the knob 26 and the tube 51. Under these circumstances, the knob 26 can actuate the latch bolt 13, thus affording the same effect as though the knob were solid to the roll-back 52. The effect of the electric remote control is to permit the lock mechanism to be operated when the circuit is energized so that the exterior knob is effective to withdraw the latch bolt.

Because of the interconnections 97 of the various parts of the lock mechanism, as shown schematically in FIG. 12 herein and exactly in the Tornoe patent, the exterior knob 26 when coupled for actuation is effective not only to withdraw the latch bolt 13 but also to withdraw the dead bolt 11 should the dead bolt be projected. This is the same operation that is accomplished when a key 29 is introduced into the tumbler mechanism 28. In effect, the energized electric remote control is tantamount to furnishing a key to the lock set.

When the remote control switch 83 is positioned to deenergize the electromagnetic coil, then the spring mechanism 64 disengages the clutch cap, provided the button 55 is properly released, and the lock is restored to its original condition with the exterior knob freewheeling and with no access to the interior possible by that means. The arrangement is also such that should the knob turn 31 have been exteriorly actuated previously to throw the dead bolt 11 outwardly, the dead bolt is retracted when the exterior knob is coupled to its spindle as described. The knob turn 31 is not effective to retract the dead bolt, in accordance with the disclosure in the Kendrick U.S. Pat. No. 3,593,548.

Should the tee turn 27 on the interior have been rotated to project the dead bolt, nevertheless when the exterior knob 26 is coupled during energization of the electromagnet, then rotation of the exterior knob 26 not only retracts the latch bolt 13 and the dead bolt 11, but also restores the tee turn 27 to its initial position.

The operation of the interior knob 24 is independent of the coupling or uncoupling of the exterior knob by the electromagnet. The interior knob 24 when rotated in either direction is always effective to withdraw the latch bolt 13 and also to withdraw the dead bolt 11 should the latch bolt have been projected by any means. The key 14 always has the ability to project the dead bolt and to withdraw both the latch bolt and the dead bolt. With this combination of elements, therefore, and the operation of the electromagnet, it is possible when power is available to provide the enablement and disablement of the outer knob 26 to withdraw the latch bolt or to withdraw both the latch bolt and the dead bolt and so unlock the lock. Should there be a power failure, then the exterior knob 26 stays in or immediately reverts to its uncoupled condition and the lock mechanism is not operable from the exterior knob 26.

As another version of the arrangement previously described, there is afforded as shown in FIGS. 9–18 a generally similar construction also involving use of the mechanism of the Tornoe patent in the same general environment. In many instances the same reference numerals are utilized where applicable.

In the present version, the chassis carries the customary exterior knob 26, which is not keyed, so the device is devoid of a separate tumbler mechanism such as 28. This form does retain on the exterior a turn knob 31. Comparably, on the interior there is still afforded a tee turn 27 and an interior knob 24 with the customary central thumb button 55. In this arrangement, the exterior knob turn 31 is on the same axis 99 as the tee turn 24 and occupies the same location as does the key, as shown in FIG. 1. In this environment, the tee turn 27 has a hub 101 and is rotatable in the casing 33, and therein is provided with the customary mechanism 102 joining the tee turn to the remaining parts of the structure, as in the Tornoe patent. Furthermore, the tee turn has a non-circular slot engagement with the flat portion of a spindle bar 103 rotatable about the cross axis 99 and within the bore 17. In this case there is no extended bore such as 68 because there is provided within the regular cross bore 17 as electromagnetic device 106 joined in a circuit as disclosed in FIG. 1 and including a coil 107. An armature 108 is fast on a round portion 109 of the spindle bar 103.

Symmetrical about the axis 99 is a hub 111. This is rotatable about the axis and is formed with a pair of flat portions 112 (FIG. 13) providing a nonrotatable interengagement with the knob turn 31, rotatably retained in the casing 44. Upon rotation of the knob turn 31, the hub 111 is similarly rotated. Rotating with the hub is an integral lug 119 stopped in two extreme positions by a button 121 outstanding from a part of the lock chassis 16. The rotation of the hub 111 between these limits is accompanied by flexure of a coil spring 122, one end of which is anchored by a post 123 engaging the lock chassis, and the other end of which is curved around and engages in a hole 124 in the hub 111. So far as the influence of the spring 122 is concerned, it urges the knob turn 31 to occupy a position for ready engagement of clutch members, to be described.

The hub is engaged with a clutch shaft 126. The two are connected together by a cross pin 127 for rotation in unison. The clutch shaft 126 is circular cylindrical for the most part, but at its exposed end is formed with a short quadrant cutaway portion 128 and a quadrant extended portion 129. The clutch shaft 126 is designed to cooperate with the end of the bar 109, which has a short quadrant extension 131 intended to mate with the quadrant recession 128 and also has a long quadrant cutaway 132 adapted to receive the quadrant projection 129.

As particularly shown in the diagrammatic FIG. 12, the quadrant projection 131 is, with considerable lost motion, in the path of counterclockwise rotation of the projection 129. Thus, when the knob turn 31 is rotated a quarter turn generally counterclockwise as seen from the exterior and in FIG. 13, for example, such rotation is accompanied by rotation of the clutch shaft 126. The quadrant 129, being shown in abutment with the quadrant 131 on the bar 109, simultaneously and correspondingly rotates the spindle 103 and the tee turn 27 counterclockwise. As shown diagrammatically herein and fully disclosed in the Tornoe patent, the dead bolt 11 is and can always be projected from its retracted position.

If the thumb turn 31 is rotated a half turn from the FIG. 13 position or three-quarters of a turn from the bolt projected position in a clockwise direction, the quardant 129 simply retreats from abutment with the quadrant 131 and is ineffective to withdraw the latch bolt 11. Thus, the exterior knob turn 31 is always effective to project the latch bolt but is always ineffective to withdraw the latch bolt. The dead bolt 11 cannot be withdrawn from the exterior. Although the exterior knob 26 can withdraw the latch bolt 13, this alone does not permit the door to be opened, as the knob 26 cannot withdraw the dead bolt.

Pursuant to the invention, when the electrical circuitry is energized to energize the coil 107, then the armature 108 is drawn farther into the coil, to the right in FIG. 11, and the axially movable spindle 103 moves toward the knob turn 31, thus fully engaging the quadrant 131 in the quadrant cutout 128, and fully engaging the quadrant 129 in the cutout 132. In effect, this makes the shaft 126 and the spindle 103 one piece. Under this condition, counterclockwise rotation of the exterior knob turn 31 will, as before, project the dead bolt 11, but, unlike the previous operation, rotation of the knob turn 31 in the clockwise direction will retract the dead bolt 11 as well as the latch bolt 13, so that the door panel can easily be opened from the exterior. When the electrical circuit is opened, an axial spring 133 abutting the hub 111 and a stop collar 134 on a sleeve 136 around the armature 108 substantially disengages the quadrants axially. The coil spring 122 returns the knob turn 31.

The foregoing operations are diagrammed in FIGS. 13–18 inclusive. In FIG. 13 the axial relationship of the parts is shown, and in FIG. 14 the polar relationship is shown in an unlocked and unenergized condition. The hub 111 is in a starting position and the flat spindle 103 is generally horizontal, while the tee turn 27 is vertical with the dead bolt 11 withdrawn. When the knob turn 31 is rotated counterclockwise and the hub 111 and lug 119 revolve therewith, the lug when moved approximately ninety degrees winds the spring 122 accordingly and likewise causes the quadrant 129 into abutment with the quadrant 131 to rotate the spindle 103 and the tee bar 27. By the Tornoe mechanism, the spindle 103 (diagrammatically shown herein) is joined to and also turns a flat spindle 137 to project the dead bolt 11.

FIG. 14 illustrates the parts in their polar or rotary positions at the beginning of this knob rotation. When approximately 90° of rotation has occurred, then the parts are as shown in FIG. 15, the tee turn 27 having been rotated from a substantially vertical position into a substantially horizontal position, and the dead bolt 11 having been put in projected position. Thereafter, the knob turn 31 is freely rotated back from the button 121 either by hand or by the coil spring 122. This restores the quadrant 129 from abutment with the quadrant extension 131 to a position affording lost motion therebetween. The new, released position of the parts is illustrated in FIG. 16, with the parts directly connected to the knob turn back in their original positions. The dead bolt 11 cannot be retracted by rotating the knob turn 31 clockwise because of lost motion.

When the electrical circuit is closed and the solenoid coil 107 is energized, the clutch quadrants 129 and 131 are fully engaged and the knob turn 31 is in effect solidly connected to the spindle 103. Then, when the knob turn is rotated a quarter turn counterclockwise, as shown in FIG. 17, the quadrants 129 and 131 turn together and the spindle 103 is rotated into a position, as shown in FIG. 18, to project the dead bolt. In this instance, and since the quadrants 129 and 131 are locked together for both directions of operation, a clockwise turn of the knob turn for a quarter rotation moves the parts from their FIG. 18 position back to their FIG. 17 position, and the dead bolt is again in retracted position, and the door is thus unlocked from the exterior.

It will be noted that when the electromagnetic device 106 is energized, the tee turn 27 and the knob turn 31 are connected and rotate together in both directions. When the electromagnetic device 106 is deenergized, there is only a lost-motion, one-way connection between the knob turn and the tee turn, since immediately upon interruption of current to the coil 107 the spring 133 pressing against the interior of the hub 111 and the stop collar 134 on the sleeve 136 against the armature urges the solenoid armature 108 to the left in FIG. 11 and slides the flat spindle 103 within the non-circular opening in the hub 101 of the tee turn and thus disengages the quadrant clutch. Thereafter and while the solenoid is deenergized, the external knob turn 31 is still effective to project the dead bolt but is ineffective to withdraw the dead bolt.

The main connections between the several knobs or lock operators are generally as previously described. When the solenoid is deenergized, the lock mechanism can be operated to the extent that the external knob 26 will withdraw the latch bolt 13 if the button 55 is projected but is ineffective upon the dead bolt 11. The interior knob 24 will always withdraw the latch bolt as well as the dead bolt. If the central button 55 is depressed, the outer knob 26 is disconnected and simply spins freely. Furthermore, the tee turns 27 can always project the dead bolt and can always withdraw the latch bolt and the dead bolt. Also, the knob turn 31 can always project the dead bolt but cannot retract the dead bolt unless the electromagnet 106 is energized, in which case the knob turn 31 can also retract the dead bolt and by the interior mechanisms, as in the Tornoe patent, can also retract the latch bolt, so that access can be had from the exterior.

In a third version of the invention, as illustrated particularly in FIGS. 19, 20 and 21, the arrangement is similar to those previously described. That is, on the interior there is an interior knob 24 which is not provided with a thumb button 55 as before, and there is likewise a tee turn or tee handle 27 exactly as before. Both of these instrumentalities are arranged to control a latch bolt 13 and a dead bolt 11. On the exterior 22, however, the situation is reversed from the showing in FIG. 8, in that opposite the interior knob 24 and on the same axis 21 therewith is the pin tumbler lock structure 28 operated by a key 29. Opposite the tee turn 27 and on the same axis therewith is the exterior knob or handle 26. These instrumentalities are all generally interconnected in the casings 33 and 44 by the previously mentioned Tornoe mechanism. In the present instance there is an electromagnetic clutching arrangement.

As shown particularly in FIG. 21, the tee turn 27 has a hub 151 rotatable in the casing 33 and carrying with it for rotation but separately for sliding movement a flat spindle bar 152. This merges with a circular cylindrical spindle rod 153 carrying an armature 154 positioned by rings 156 and 157 against axial movement. The armature is within an electric coil 158 surrounding a sleeve 159 within which the armature 154 is slidable. The coil 158 is connected to the circuit shown in FIGS. 1 and 5, so that when the circuit is open or the coil 158 is not energized, the armature 154 occupies the position shown in FIG. 21. However, when the coil 158 is energized, the armature 154 is translated toward the right in that figure, sliding the spindle bar 152 to the right in the non-circular opening in the hub 151 and simultaneously compressing a spring 160. This bears against a plug 161 in the end of the sleeve 159 and rests against a closure washer 162

This translation of the spindle rod 153 causes a clutch cup 163, connected to the spindle rod by a cross pin 164, to move to the right far enough so that lugs 166 on the clutch cup interengage with a cross bar 167 in a clutch hub 168. The cross bar 167 also fixes the clutch cup against axial movement and rotation with respect to a short spindle 169 for the exterior knob 26. The spindle 169 is non-circular, being provided with valleys 171 also engaging correspondingly shaped portions of the hub 168.

With this arrangement and while rotation of the exterior knob 26 freely rotates its spindle 169 in a bearing 172, and simultaneously rotates the clutch hub 168 about the cross axis 173, nevertheless the bar 167, being out of the influence of the lugs 166 when the coil 158 is deenergized and the spring 160 predominates, is ineffective to turn the spindle 153, so that the tee turn 27 and the connected mechanism to the remainder of the lock are not actuated. However, whenever the coil 158 is energized and the armature 154 is translated against the spring force and toward the right, then the clutch cup 163 comes into interengagement with the cross bar 167, thus effectively uniting the spindle 152 and the knob 26. Rotation of the knob under those circumstances causes rotation of the spindle 152 and operation of the interior mechanism, not only rotating the tee turn 27, but likewise serving to project or retract the dead bolt 11 and retract the latch bolt 13. Simultaneously through the interconnected mechanism as in the Tornoe patent, this actuation of the external knob when the electromagnet is energized simultaneously withdraws the latch bolt. Entry can be gained from the outside without any key, but only so long as the electromagnet is energized.

With this arrangement and with no electrical energization, the knob 26 is free-spinning and has no effect on the rest of the lock. The key 29 always has the ability to project the dead bolt 11 and to retract the dead bolt and the latch bolt 13. The knob turn 31 always has the ability to project the dead bolt 11, but has no ability to retract the dead bolt under any circumstances. The interior knob 24 always has the ability to retract both the dead bolt and the latch bolt. The tee turn 27 is always effective to project the dead bolt and also to retract the dead bolt as well as the latch bolt.

I claim:

1. An electrically controlled door lock for use in a door panel having a bore therein comprising a lock chassis adapted to be disposed on said door panel, a lock bolt adapted to be disposed on said door panel, a spindle on said chassis rotatable about an axis, means for connecting said spindle to operate said lock bolt, a door handle, means for mounting said door handle on said door panel for rotation about said axis, a clutch including a member adapted to engage and to disengage said handle and said spindle, an electromagnet frame in said bore, an electromagnet on said frame, an armature operable by said electromagnet, and means for interconnecting said armature and said clutch member for conjoint movement.

2. A device as in claim 1 in which said member is slidable along said axis, and said interconnecting means is movable with a component along said axis.

3. A device as in claim 1 in which said panel has an interior side and an exterior side, and said door handle is on said exterior side.

4. A device as in claim 1 including a second door handle, and means for permanently connecting said second handle and said spindle for conjoint rotation.

5. A device as in claim 1 in which said electromagnet includes an annular coil and said electromagnet frame supports said coil coaxially with said axis.

6. A device as in claim 1 in which said bore is disposed at a right angle to said axis, and said electromagnet is in said bore.

7. A device as in claim 1 in which said interconnecting means is effective to engage said member with said handle only when said electromagnet is energized.

8. A device as in claim 1 including means for resiliently urging said member to disengage said handle.

9. A device as in claim 1 in which said clutch includes oppositely facing jaws axially movable relative to each other, and means for holding said jaws in relative polar positions for ready axial engagement.

10. A device as in claim 1 including a circuit connection for said electromagnet, and means for variously connecting said electromagnet in said circuit depending upon the position of said armature.

11. A device as in claim 1 including in said clutch members movable axially relatively to each other between a first position and a second position and engageable with each other in said first position with some rotary lost motion and engageable with each other in said second position without said rotary lost motion.

12. A device as in claim 1 in which said spindle is hollow, and said clutch member is substantially housed within said spindle.

13. An electrically controlled door lock comprising a lock chassis, a lock bolt movable relative to said chassis, a door handle rotatable relative to said chassis, means including a clutch for interconnecting said lock bolt and said door handle, and an electromagnet connected to said chassis for operating said clutch.

14. A device as in claim 13 in which said clutch is operable solely by said electromagnet.

* * * * *